United States Patent [19]

Tozawa et al.

[11] Patent Number: 4,825,935

[45] Date of Patent: May 2, 1989

[54] COOLING PAD ARRANGEMENT FOR BELT CASTER TYPE CONTINUOUS CASTING DEVICE

[75] Inventors: Hirokazu Tozawa; Nagayasu Bessho; Tetsuya Fujii; Saburo Moriwaki; Noboru Yasukawa, all of Chiba; Tomoaki Kimura, Ibaragi, all of Japan

[73] Assignee: Kawasaki Steel Corporation, Tokyo, Japan

[21] Appl. No.: 130,601

[22] Filed: Dec. 9, 1987

[30] Foreign Application Priority Data

Dec. 10, 1986 [JP] Japan ..... 61-292551

[51] Int. Cl.[4] ..... B22D 11/06; B22D 11/124

[52] U.S. Cl. ..... 164/481; 164/485; 164/443; 164/432

[58] Field of Search ..... 164/443, 485, 431, 432, 164/481; 165/120; 62/374

[56] References Cited

U.S. PATENT DOCUMENTS 4,679,611 7/1987 Yoshida et al. ..... 164/431

*Primary Examiner*—Kuang Y. Lin

*Attorney, Agent, or Firm*—Austin R. Miller

[57] ABSTRACT

In order to securely hold a moving belt of a continuous casting device against selective movable side walls, a first group of rotatable control rods which are disposed in a first supply header and an adjacent exhaust header are arranged to produce narrow high pressure zones in the film defined between the cooling pad in which the header are formed and the moving belt. These zones can be selectively moved to juxtapose the side walls when the gap between the walls is adjusted. A second group of rotatable control rods which are disposed in second and third supply headers selectively heat the side edges of the belt which are relatively cool as compared with the center section which is exposed to molten metal. As the side walls are moved apart the width of the edge sections which are exposed to pre-heated coolant can be reduced and the amount of normal temperature coolant applied thereto also increased.

8 Claims, 5 Drawing Sheets

HIGH PRESSURE ZONE
NORMAL PRESSURE ZONE
HIGH PRESSURE ZONE
HIGH PRESSURE COOLANT
NORMAL PRESSURE COOLANT
HIGH PRESSURE COOLANT
20 HP
22 NP
20 HP

PRE-HEATED COOLANT ZONE
PRE-HEATED COOLANT ZONE
HIGH TEMPERATURE COOLANT
NORMAL TEMP. COOLANT
HIGH TEMP. COOLANT
HT 22
22 NP
22 HT

22 NP

Wmin
NORMAL PRESSURE COOLANT
HIGH PRESSURE COOLANT
Wmax
HIGH PRESSURE COOLANT
HIGH PRESSURE COOLANT
HIGH PRESSURE APPLICATION RANGE
HIGH PRESSURE EXHAUST RANGE
EXHAUST COOLANT

NORMAL COOLANT
HOT COOLANT

HEATING RANGE

NORMAL COOLANT
MOULD WIDTH VARIATION
Wmin
Wmax

COOLING PAD ARRANGEMENT FOR BELT CASTER TYPE CONTINUOUS CASTING DEVICE

BACKGROUND OF THE INVENTION

1. Field of the Invention

The present invention relates generally to continuous casting arrangements for producing sheet or bar steel or the like metal and more specifically to a cooling pad arrangement therefor which is used to cool and control the belt during the casting process.

2. Description of the Prior Art

JP-A 58-38642 discloses an arrangement of the nature shown in FIG. 1 wherein two stationary side plates cooperate with a pair of circulating belts which define the basic elements of continuous casting device. The side plates can be selectively moved toward and away from each other in a manner permitting the width of the casting to be varied within limits.

Cooling pads are operatively disposed against the inner surfaces of the belts in order to remove the heat imparted to the same by the molten metal. This type of arrangement requires that the belt be held in contact with the side plates in a manner which obviates leakage and the formation of fins or the like type of imperfections along the edge of the casting.

JP-A 61-115625 discloses a cooling pad arrangement which is designed to provide a cooling film of coolant between it and the moving belt in a manner which both removes excess heat from the belt and simultaneously provides sufficient hydraulic pressure to hold the edges of the belt against the side plates in a manner which prevents the leakage of molten metal therebetween and the subsequent formation of the above mentioned fins.

However, even though this arrangement provides sufficient pressure to hold the belt against the side plates, a problem is encountered in that the flow of coolant at or near the edges of the belt (which are not heated by to the same degree as the center section of the belt) cools the same to the degree that a temperature differential is produced between the edges of the belt and the center section thereof. This temperature differential induces a stress which acts in the moving direction of the belt and which reduces the working life of the same.

SUMMARY OF THE INVENTION

It is an object of the present invention to provided a cooling pad arrangement which provides sufficient pressure against the edges of the belt in sliding contact with the side plates so as to obviate leakage and which further enables the relatively cool edge sections of the belt to be heated to a point where an excessive temperature differential is negated and obviates the stress which reduces the life of the belt.

In brief, the above object is achieved by an arrangement wherein a first group of rotatable control rods which are disposed in a first supply header and an adjacent exhaust header are arranged to produce narrow high pressure zones in the film defined between the cooling pad in which the header are formed and the moving belt, which zones can be selectively moved to juxtapose the side walls when the gap between the walls is adjusted. A second group of rotatable control rods which are disposed in second supply headers selectively heat the side edges of the belt which are relatively cool as compared with the center section which is exposed to molten metal. As the side walls are moved apart, the width of the edge sections which are exposed to preheated coolant are reduced and the amount of normal temperature coolant applied thereto are accordingly increased.

More specifically, a first aspect of the present invention comes in the form of a continuous casting system wherein a moving belt is exposed to molten material on one face and is cooled on the other face by the provision of a cooling pad which is juxtaposed thereto and which produces a film of coolant therebetween, and wherein side plates are arranged with the moving belt to retain the molten material, the side plates being selectively movable in a manner which permits the width of the gap defined therebetween to be changed within predetermined limits.

The system features: first rotatable control rod means disposed in a first coolant supply header and an adjacent coolant exhaust header for: (a) producing narrow high pressure zones in the film defined between the cooling pad in which the headers are formed the moving belt, and (b) enabling the narrow high pressure zones to be selectively moved to juxtapose the side walls when the gap between the side walls is adjusted; and second rotatable control rods means disposed in second supply headers for: (a) applying pre-heated coolant to selectively heat the side edges of the belt which are relatively cool as compared with the center section thereof which is exposed to the molten metal, (b) changing the width of the zone to which the preheated coolant is applied against the side edges in accordance with the distance between the side walls, and (c) changing the width of the belt exposed to normal temperature coolant in accordance with the change in width of the zone to which pre-heated coolant is applied.

A second aspect of the present invention comes in the form of a method of cooling applied to a continuous casting system wherein a moving belt is exposed to molten material on one face and is cooled on the other face by the provision of a cooling pad juxtaposed thereto and which produces a film of coolant therebetween, and wherein side plates are arranged with the moving belt to retain the molten material, the side plates being selectively movable in a manner which permits the width of the gap defined therebetween to be changed within predetermined limits.

The cooling method features the steps of: using first rotatable control rod means disposed in a first supply header and an adjacent exhaust header for: (a) producing narrow high pressure zones in the film defined between the cooling pad in which the header is formed and the moving belt, (b) enabling the narrow high pressure zones to be selectively moved to juxtapose the side walls when the gap between the side walls is adjusted; and using second rotatable control rods means disposed in second supply headers for: (a) applying pre-heated coolant to selectively heat the side edges of the belt which are relatively cool as compared with the center section thereof which is exposed to the molten metal, (b) changing the width of the zone to which the preheated coolant is applied against the side edges in accordance with the distance between the side walls, and (c) changing the width of the belt exposed to normal temperature coolant in accordance with the change in width of the zone to which pre-heated coolant is applied.

A further aspect of the invention takes the form of a cooling pad for a system for cooling a surface adjacent thereto, which system includes: a first supply header formed in the cooling pad; a row of first supply ports which extends laterally across the coolant pad, the supply ports fluidly communicating with the first supply header; a first supply of high pressure coolant, the first supply of coolant communicating with an end section of the first supply header; a second supply of coolant under normal pressure, the second supply fluidly communicating with a center section of the first supply header located adjacent the end section; a first rotatably control rod disposed in the end section of the first header; a first baffle arrangement on the control rod, the first baffle arrangement being arranged to fluidly isolate the first and second source of coolant and prevent any of the supply ports which open into the end section from communicating with the first source of coolant, the baffle arrangement further arranged so that, as the control rod is rotated between first and second rotational positions, a narrow window through which coolant from the first source is supplied to the supply ports moves from one end of the end section toward the other in a manner that coolant from the first source is supplied a film of coolant defined between the belt and the pad in a predetermined zone which zone moves laterally along the end section of the first header as the control rod is rotated between the first and second predetermined positions.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DETAILED DESCRIPTION OF THE PREFERRED EMBODIMENTS

Figure 1:
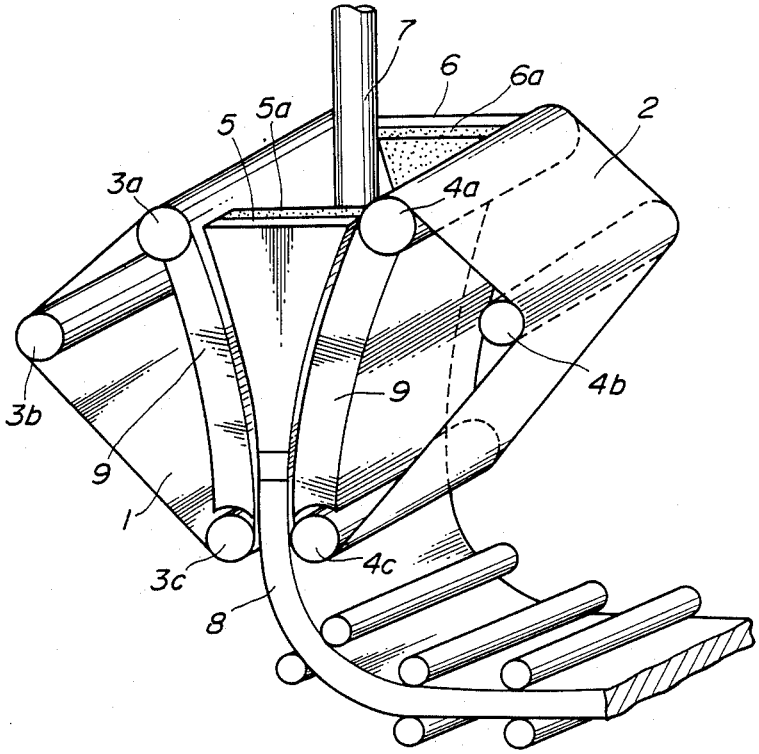
FIG. 1 is a perspective view showing a belt type continuous casting arrangement of the type to which the present invention is applied.

The present invention is applied to the type of arrangement shown in FIG. 1. In this arrangement, as briefly described hereinbefore, two metal belts 1 and 2 are supported on guide rollers 3*a*–3*c* and 4*a*–4*c* in the illustrated manner. Side plates 5 and 6 are disposed between the belts. These side plates 5, 6 are arranged to be selectively movable toward and away from each other in a manner which permits the width of the gap defined therebetween to be adjusted within predetermined limits. Refractory linings 5*a* and 6*a* are disposed on the inboard faces of the plates 5 and 6 respectively. A delivery nozzle 7 through which molten metal is supplied into the casting device is arranged as shown.

In the instant arrangement the nozzle 7 has a diameter in excess of 100 mm and the strip of metal 8 produced has a thickness of less than 50 mm. As a result, the shape of the side plates 5, 6 and the refectory linings 5*a* and 6*a* assumes the form of inverted triangles.

Figure 2B:
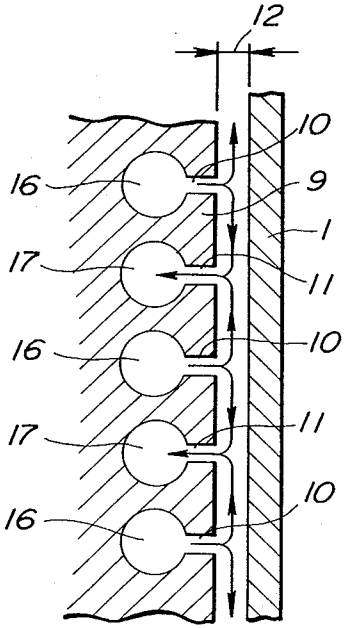
FIGS. 2 (*a*) and (*b*) are respectively a schematic front elevational view of the cooling pad arrangement according to the present invention which demonstrates the coolant flow pattern which is induced at the edges of the belt, and a side sectional view of the same section of the pad showing the provision of the coolant supply and exhaust headers.
Figure 2A:
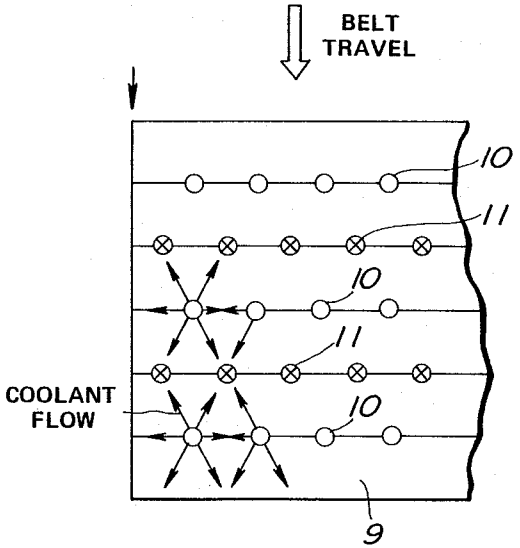

Cooling pads 9 are disposed against the inner surfaces of the belts 1 and 2 in a manner as illustrated. These pads 9 as shown in FIGS. 2*a* and 2*b* include a series of coolant supply ports 10 and a series of drain or exhaust ports 11. These ports 10, 11 are respectively arranged in rows which extend laterally across the face of the pads 9. In the prior art the rows of supply and drain ports 10, 11 are arranged to alternate in the casting or belt travel direction (viz., the direction in which the belts 1 and 2 are arranged to be driven). With the embodiment of the present invention this order is also maintained.

The supply and drain ports 10, 11 respectively communicate with coolant supply and exhaust headers 16, 17 which extend laterally through the pads 9 and which supply coolant to and subsequently drain the same from a film 12 which is defined between each belt and the adjacent face of the respective cooling pad 9.

With this arrangement the coolant discharge from each of the supply ports 10 tends to be distributed to four adjacent drain ports 11 in a manner such as depicted by the coolant flow arrows in FIG. 2*a*.

Figures 3A, 3B, 3C, 3D:
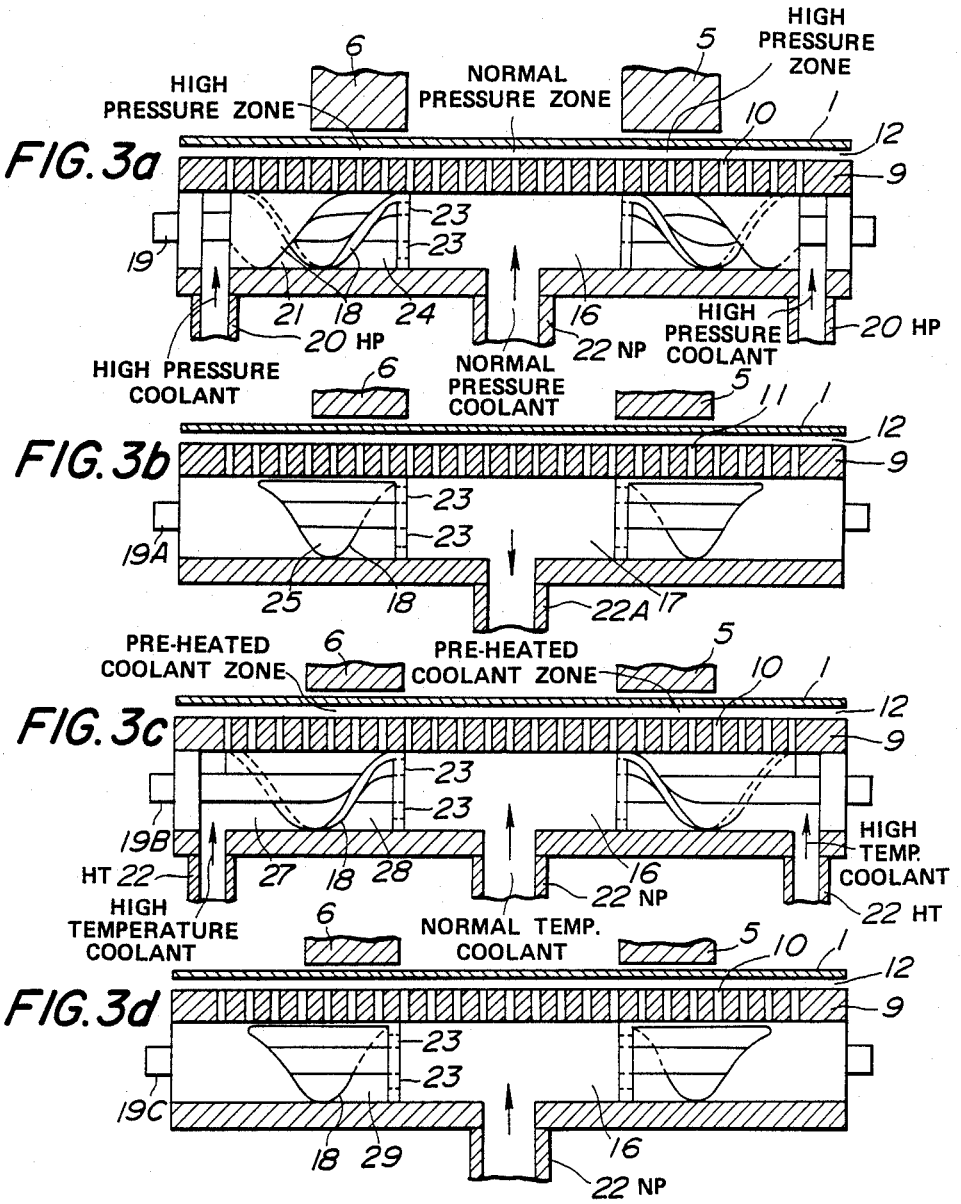
FIGS. 3(*a*) to 3(*d*) are front sectional elevations of the coolant supply and exhaust headers showing the provision of rotating control members which are disposed therein and which control the amount and pressure of the coolant in the side edge zones of the belt.

The instant embodiment makes use of three distinct supplies of coolant as illustrated in FIG. 3. One is a normal or relatively low pressure supply (NP) which is fed into the supply headers 16 at locations essentially the mid section thereof via supply conduits 22NP. The second is a high pressure (HP) supply which is supplied via conduits 20HP to selected supply headers just inboard of the ends thereof. The third supply takes the form of preheated high temperature coolant which is supplied to selected supply headers via conduits 22HT.

The present embodiment further employs first pairs of adjacent supply and exhaust headers to provide an adequately high pressure low flow volume zones which produce the required bias to prevent leakage and second pairs of adjacent headers to heat the cool sections of the belt in a manner to reduce the temperature differential which induces the life reducing stress discussed hereinbefore.

Each of the supply and drain headers are provided with two rotatable control valve or rods (one in each end) which control the mode of supply and drainage of coolant at the lateral side sections of the coolant film 12.

Figure 4:
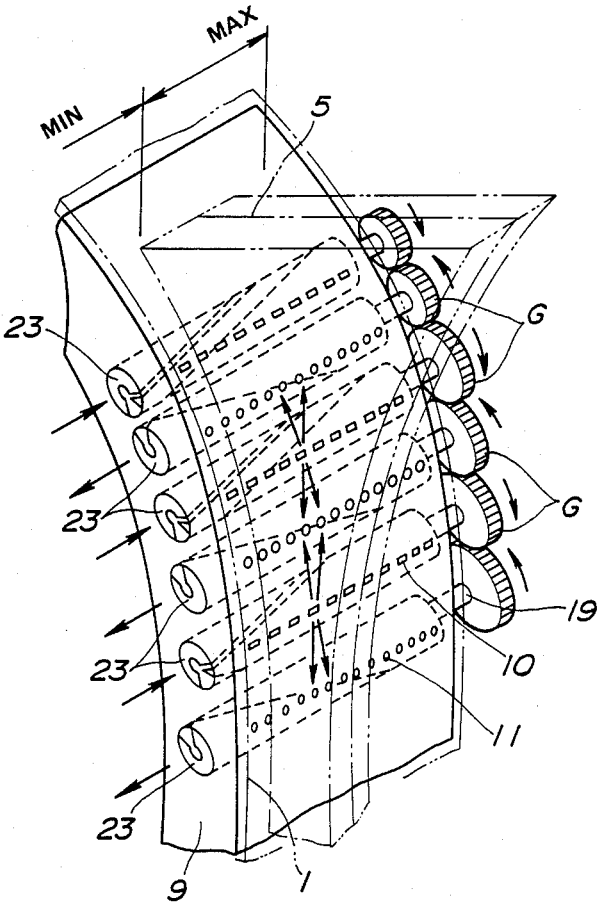
FIG. 4 is a perspective view showing the arrangement of the rotating control members in the respective headers and the connection technique which enables synchronous rotation between each of the members to be ensured.

As shown in FIG. 4 the control rods are provided with cogs or gears which intermesh in a manner which interconnects the same and enables the selective synchronous contra-rotation of each pair of rods.

FIGS. 3(*a*) and 3(*b*) show in detail a first pair of supply and exhaust headers. The control rods 19 disposed in the supply headers have a land (no numeral) at the outboard ends thereof which closes the header and prevents the wasteful loss of coolant. The high pressure supply control rods 19 (as they will be referred to hereinafter) further have lands on the inboard ends. Ports 23 formed in the inboard lands provide limited fluid communication between the section of the supply header 16 supplied with coolant under normal pressure and the section of the headers occupied by the high pressure supply control rods.

The high presure supply control rods are further provided with a helical baffle arrangement 18 which defines first and second channels 21 and 24 within the sections occupied by the control rods 19. The first channel 21 is fluidly isolated from the second one 24 by the baffle 18 and arranged to receive the high pressure coolant from conduit 20HP. The second channel 24 is arranged to communicate with the central portion of the header 16 into which coolant is supplied via conduit 22NP via ports 23. In this arrangement the helical baffles also define a helical opening or window via which the high pressure coolant supplied through conduits 20HP can be delivered to a limited number of the supply ports which open into the sections in which the control rods 19 are disposed.

It should be noted at this point that the instant embodiment of the present invention is also arranged so that all of the control rods (19, 19A, 19B and 19C) extend into the respective headers to the level which corresponds essentially with the minimum clearance defined between the side walls 5, 6. In other words, the control rods arranged to span the zone in the side walls are movably adjustable. FIGS. 3(*a*)–(*d*) show the side walls moved to positions wherein the minimum gap therebetween is defined. The reason for this will become more apparent hereinafter.

Figures 5A, 5B, 5C, 5D:
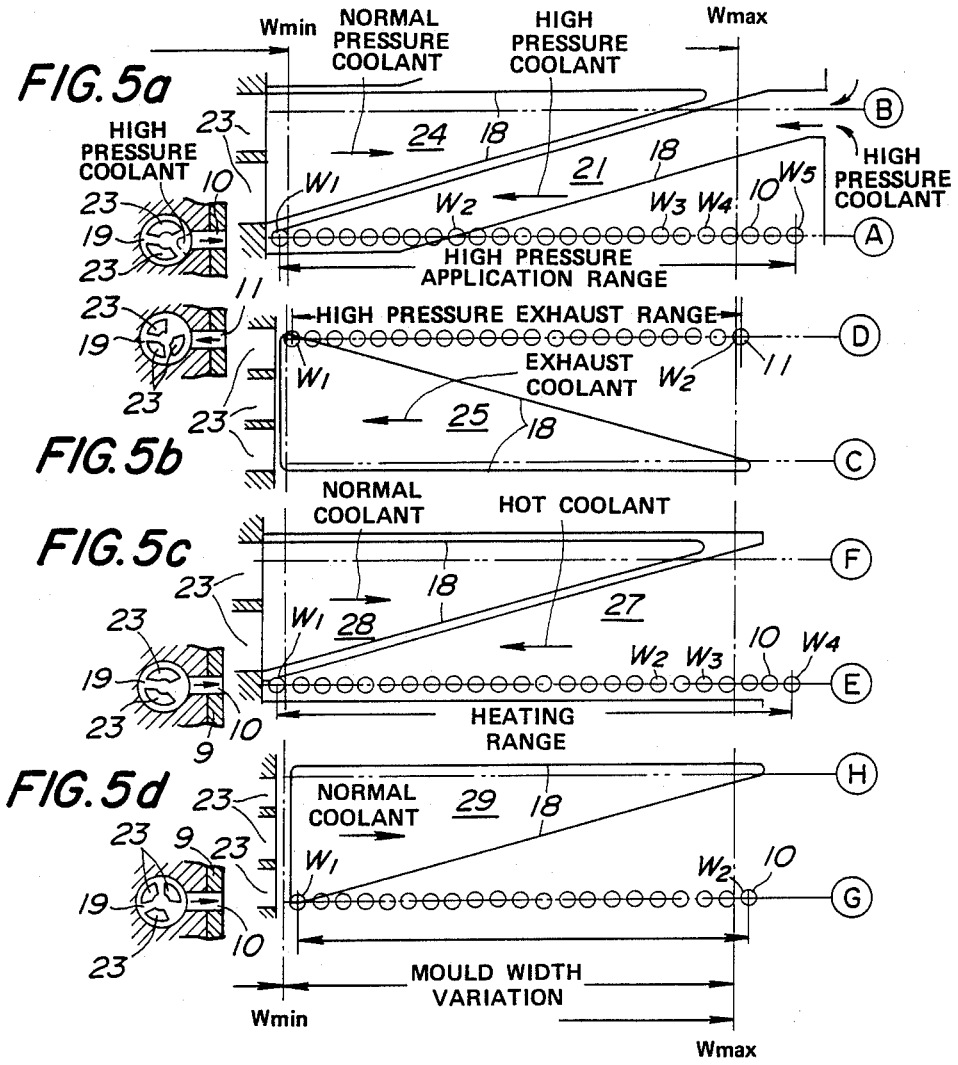
FIGS. 5(*a*) to 5(*d*) are respectively side views of each of the arrangements shown in FIGS. 3(*a*) to 3(*d*) showing the function of the partitions formed on the rotating control members and the control exerted by the same on the coolant pressure and flow.

The operation of the arrangement shown in FIG. 3(*a*) is such that during casting, high pressure coolant is supplied to the supply header 16 via conduits 20HP while the lower pressure coolant is fed into the central section thereof via conduit 22HP. As shown in FIG. 5(*a*), when control rods 19 are rotated to a position wherein the imaginary line A is aligned with the row of supply ports 10, the helical baffles 18 are located and arranged so that the high pressure coolant is supplied only to the ports in the narrow range W1 to W2. Thus, as control rods 19 are rotated in the direction which brings an imaginary line B into alignment with the row of supply ports, the narrow zone in which high pressure coolant is supplied with high pressure coolant moves in the outboard direction until only the ports in the range W4 to W5 are supplied.

It will be noted that the supply ports 10 are arranged so that the minimum width setting of the side plates is such as to be aligned essentially with the most inboard high pressure supply port while the maximum width setting is close to the most outboard high pressure supply ports. Hence, by rotating the control rods 19 shown in FIG. 3(*a*) in accordance with the setting of the side plates, it is possible to control the location in which high pressure coolant is supplied so that the force produced by the streams of high pressure fluid ejecting from the supply ports into the film 12 acts on a relatively narrow zone which is directly opposite the side wall.

This relatively high pressure relatively low flow volume zone ensures that the belt is biased against the side walls in a manner tending to prevent leakage of molten metal.

Control rods 19A shown in FIG. 3(*b*) which control the adjacent row of exhaust ports 11 are constructed so that the helical baffles 18 permit the exhaust port 11 which open on the inboard side of the same to communicate with the ports and thus enable the draining of the coolant which enters the exhaust headers therethrough. When the side plates are moved to the position wherein the gap therebetween is minimized, the control rods are set so that line D is aligned with the row of drain ports 11. When the maximum width setting of the side plates is selected the control rods are rotated to the position wherein line C is aligned with the ports.

The helical baffles on the control rods 19A are arranged to partition the sections of the exhaust header 17 in which the rods 19A are received into first and second channels. Of these two channels only channel 25 is permitted to intercommunicate with exhaust ports 11 and the central portion of the exhaust header via the ports 23 formed in the inboard lands.

When the control rod 19A is located so that line D is aligned with the row exhaust ports 11 only a limited number of the ports at the inboard end of the row are able to communicate with the discharge conduit 22A via the ports 23. As the rod 19A is rotated toward the position in line C, supply ports 10 approach and align with the row of ports 11, thereby increasing the number of exhaust ports which are in fluid communication with channel 25 toward the maximum number.

In the instant embodiment, as the control rods 19 and 19A are interconnected by the gears G as the control rod 19 is rotated in the direction of line B toward the row of supply ports 10 the control rod 19A is simultaneously rotated in the opposite direction in a manner which brings line C toward the row of drain or exhaust ports 11.

Hot coolant, such as water or a similar liquid at about 95° C., is supplied into the supply header in which control rods 19B are disposed. In this arrangement the helical baffle 18 formed on the rod is formed so that the high temperature coolant is prevented from communicating with the central portion of the header via ports 23. The baffles 18 divide the sections of the supply header 16 in which control rods 19B are disposed into fluidly isolated channels 27 and 28. The channels 27 are arranged to fluidly communicate with the source of high temperature coolant while channels 28 are arranged to communicate with the central portion of the header via ports 23.

As best seen in FIG. 5(*c*) the rod is arranged so that when the side plates are moved to their minimum width setting, the control rods 19B are rotated to the position wherein line E is aligned with the supply ports 10. Under these conditions all of the supply ports in the range of W1 to W4 communicate with channel 27 and are supplied with heated coolant. As the side plates 5, 6 are moved from their minimum width positions to the maximum width ones, the control rod 19B is rotated to the position wherein the line F is aligned with the row of supply ports. Under these conditions the only ports in the range of W3 to W4 are able to discharge heated coolant into the coolant film 12.

The reason for this arrangement is that when the side plates are moved to their minimum width positions, the width of the lateral side portions of the belt which is not heated due to exposure to the molten metal are maximized. Under these conditions the tendancy for a large temperature differential to develop is high and it is necessary to heat these relatively wide cool bands along each side of the belt. However, as the side plates are moved toward their maximum width positions, the width of the unheated bands narrows considerably. Thus, the amount of heating required for the sake of temperature differential obviation is reduced.

The header arrangement shown in FIG. 3(*d*) is designed for use in locations where it is required to conserve the amount of coolant which is being used and wherein it is not necessary to control the pressure of the film produced between the belt and the cooling pad. For example, the rods shown in this figure can be disposed in downstream locations with respect to the casting direction (viz., the direction in the belts 1 and 2 run) and in the lower portion of the cooling pad. This type of rod can also be used at locations upstream of the molten metal meniscus level. When the side plates 5, 6 are moved, the control rods 19C can be rotated to control the width of the coolant supply and thus effect the above mentioned economization while ensuring that the film of coolant between the levels of the side walls is maintained at the desired thickness.

By way of example, it is possible to arrange the above described arrangements from the top to the bottom of the cooling pads in the following sequences. Note that in the following sequences the rods shown in FIGS. 3(*a*) to 3(*d*) will be denoted simply as a, b, c and d.

I. a-b-a-b-a-b-a-b-d-b-d-b-d
(note that the first d rod is located more than halfway down the pad);

II. d-b-d-b-a-b-a-b-a-b-d-b-d-b-d-b-d
(note that in this sequence the first and second d rods are disposed above the level of metal meniscus);

III. d-b-a-b-a-b-a-b-a-d-b-o-o-o-o-o
(in this sequence "o" denotes headers which are not provided with control rods);

IV. d-b-c-b-c-b-c-b-c-b-c-b-c-b-c-b-c
(this sequence is primarily aimed at belt temperature control);

V. d-b-c-b-a-b-a-b-a-b-c-b-c-b-c-b
(for pressure control in the upper sections and temperature control in the following section); and VI. d-b-c-b-a-b-c-b-a-b-c-b-c-b-c-b
(for pressure control and wherein pre-heated coolant is not required).

It should be noted that it is necessary to alternate supply and drain headers. Accordingly, it will be understood that the headers denoted by "o" in example III, in fact denote uncontrolled supply and drain headers arranged in an alternate sequence.

As will be obvious to those skilled in the art to which the present invention pertains many other sequences of control rods are possible and can be selected on the basis of the pressure and temperature control demands of the casting system.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the disclosed embodiments which can be made without departing from the principle of the invention set out in the appended claims.

What is claimed is:

1. In a continuous casting system wherein a moving belt is exposed to molten material on one face and is cooled on the opposite face by the provision of a cooling pad juxtaposed said opposite face and which produces a film of coolant therebetween, and wherein side plates are arranged with the moving belt to retain the molten material, said side plates being selectively movable in a manner which permits the width of the gap defined therebetween to be changed within predetermined limits:

first rotatable control rod means disposed in a first coolant supply header and an adjacent coolant exhaust header for:

(a) producing a narrow high pressure zone in the film defined between the cooling pad in which the headers are formed and said moving belt;

(b) enabling said narrow high pressure zones to be selectively moved to juxtapose the side plates when the gap between said side plates is adjusted; and second rotatable control rod means disposed in second supply headers for:

(a) applying pre-heated coolant to selectively heat the side edges of said belt which are relatively cool as compared with the center section thereof which is exposed to the molten metal;

(b) changing the width of the zone to which the preheated coolant is applied against said side edges in accordance with the distance between side plates; and (c) changing the width of the belt exposed to normal temperature coolant in accordance with the change in width of the zones to which preheated coolant is applied.

2. In a method of cooling applied to a continuous casting system wherein a moving belt is exposed to molten material on one face and is cooled on the opposite by the provision of a cooling pad juxtaposed said opposite face and which produces a film of coolant therebetween, and wherein side plates are arranged with the moving belt to retain the molten material, said plates being selectively movable in a manner which permits the width of the gap defined therebetween to be changed within predetermined limits, a method of controlling the cooling of said belt comprising the steps of:

using first rotatable control rod means disposed in a first supply header and an adjacent exhaust header for:

(a) producing a narrow high pressure zones in the film defined between the cooling pad in which the header is formed and the moving belt; and (b) enabling said narrow high pressure zones to be selectively moved to juxtapose the side plates when the gap between said side plates is adjusted; and using second rotatable control rod means disposed in second supply headers for:

(a) applying pre-heated coolant to selectively heat the side edges of said belt which are relatively cool as compared with the center section thereof which is exposed to the molten metal;

(b) changing the width of the zone to which the preheated coolant is applied against said side edges in accordance with the distance between said side plates; and (c) changing the width of the belt exposed to normal temperature coolant in accordance with change in width of the zone to which pre-heated coolant is applied.

3. In a cooling pad for a system for cooling a surface adjacent thereto:

a first supply header formed in said cooling pad;

a row of first supply ports which extends laterally across the coolant pad, said supply ports fluidly communicating with said first supply header;

a first supply of high pressure coolant, said first supply of coolant communicating with an end section of said first supply header;

a second supply of coolant under normal pressure, said second supply fluidly communicating with a center section of said first supply header located adjacent the end section;

a first rotatable control rod disposed in said end section of said first header;

a first baffle arrangement on said control rod, said first baffle arrangement being arranged to fluidly isolate said first and second source of coolant and prevent any of the supply ports which open into said end section from communicating with said second source of coolant, said baffle arrangement being further arranged so that, as said control rod is rotated between first and second rotational positions, a narrow window through which coolant from said first source is supplied to the supply ports moves from one end of said end section toward the other in a manner that coolant from said first source is supplied a film of coolant defined between said belt and said pad in a predetermined zone, which zone moves laterally along said end section of said first header as the control rod is rotated between said first and second predetermined positions.

4. A cooling pad as claimed in claim 3 further comprising:

a first exhaust header formed in said pad adjacent said first supply header, said first exhaust header having an end section and central section adjacent said end section;

a row of first drain ports, said first drain ports being arranged to communicate with said first exhaust header and arranged to extend along essentially parallel with said row of first supply ports;

a drain which communicates with the center section of said exhaust header;

a second rotatable control rod, said second control rod being received in the end section of said first drain header;

a second baffle arrangement formed on said second control rod, said second baffle arrangement being arranged to selectively change the number of first drain ports which are able to communicate with said drain as said second control rod is rotated from a third predetermined position to a fourth predetermined position.

5. A cooling pad as claimed in claim 4 further comprising a first drive connection which interconnects said first and second control rods in a manner which induces synchronous rotation thereof.

6. A cooling pad as claimed in claim 4 further comprising:

a second supply header, said second supply header having an end section and a center section;

a row of second supply ports, said second supply ports fluidly communicating with said second supply header;

a third supply of pre-heated coolant, said third supply of coolant communicating with said end section of said second header;

a third rotatable control rod, said third control rod being received the end section of said second supply header;

a third baffle arrangement formed on said third control rod, said third baffle arrangement being arranged to selectively change the number of second supply ports which are able to communicate with said third source of coolant as said second control rod is rotated from a fifth predetermined position to a sixth predetermined position.

7. A cooling pad as claimed in claim 6 further comprising:

a third supply header formed in said pad, said third supply header having an end section and a center section, said center section being fluidly communicated with said second source of fluid;

a row of third supply ports, said third supply ports fluidly communicating with said third supply header;

a fourth rotatable control rod, said fourth control rod being received in the end section of said third supply header;

a fourth baffle arrangement formed on said fourth control rod, said fourth baffle arrangement being arranged to selectively change the number of third supply ports which are able to communicate with said second source of coolant as said fourth control rod is rotated from a seventh predetermined position to a eighth predetermined position.

8. A cooling pad as claimed in claim 7 further comprising a drive connection means which interconnects said first, second, third and fourth control rods in a manner wherein synchronous rotation thereof is selectively induced.

* * * * *